US007721629B2

(12) United States Patent
Shen et al.

(10) Patent No.: US 7,721,629 B2
(45) Date of Patent: May 25, 2010

(54) ADJUSTABLE RATCHET

(75) Inventors: Jue Chi Shen, Taichung (TW); Ming Tsung Tsai, Taichung County (TW)

(73) Assignee: The Stanley Works, New Britain, CT (US)

( * ) Notice: Subject to any disclaimer, the term of this patent is extended or adjusted under 35 U.S.C. 154(b) by 2 days.

(21) Appl. No.: 12/116,005

(22) Filed: May 6, 2008

(65) Prior Publication Data

US 2009/0277309 A1 Nov. 12, 2009

(51) Int. Cl.
*B25B 13/16* (2006.01)

(52) U.S. Cl. ..... 81/155; 81/170

(58) Field of Classification Search ..... 81/155, 81/163, 128, 159, 168–172, 58, 125, 156–158, 81/160, 165–167
See application file for complete search history.

(56) References Cited

U.S. PATENT DOCUMENTS

| | | | | |
|---|---|---|---|---|
| 45,931 | A | 1/1865 | Meader | |
| 266,595 | A | 10/1882 | Owen | |
| 275,079 | A | 4/1883 | Reichling | |
| 295,797 | A | 3/1884 | Osborn | |
| 331,951 | A | 12/1885 | Duell | |
| 332,522 | A | 12/1885 | Heiney et al. | |
| 335,481 | A | 2/1886 | Rettberg et al. | |
| 466,564 | A | 1/1892 | Hall | |
| 467,381 | A | 1/1892 | Parsons et al. | |
| 489,032 | A | 1/1893 | Osteen | |
| 573,732 | A | 12/1896 | Warn | |
| 594,023 | A | 11/1897 | Krueger | |
| 600,158 | A | 3/1898 | Miller | |
| 657,499 | A | 9/1900 | Peterson | |
| 791,298 | A | 5/1905 | Smith | |
| 804,568 | A | 11/1905 | Thompson | |
| 828,440 | A | 8/1906 | Sullivan | |
| 837,272 | A | 12/1906 | Allen | |
| 850,819 | A | 4/1907 | Davis | |
| 908,595 | A | 1/1909 | Moffett | |
| 1,523,749 | A | 1/1925 | Bryers | |
| 1,530,842 | A | 3/1925 | Matoushek | |
| 1,541,898 | A | 6/1925 | Chamberlain | |
| 1,733,012 | A | 10/1929 | Henderson | |
| 2,112,565 | A | 3/1938 | Hare | |
| 4,012,971 | A * | 3/1977 | Zeyher | 81/170 |
| 4,016,782 | A | 4/1977 | Guimarin | |
| 4,112,792 | A | 9/1978 | Guimarin | |
| 4,136,588 | A * | 1/1979 | Roder | 81/165 |
| 4,366,733 | A * | 1/1983 | Colvin | 81/128 |
| 4,663,999 | A * | 5/1987 | Colvin | 81/128 |
| 4,898,052 | A * | 2/1990 | Kang | 81/57.43 |
| 5,076,121 | A | 12/1991 | Fossella | |
| 5,090,273 | A | 2/1992 | Fossella | |
| 5,207,129 | A | 5/1993 | Fossella | |
| 5,305,670 | A | 4/1994 | Fossella et al. | |
| 5,448,931 | A | 9/1995 | Fossella et al. | |

(Continued)

*Primary Examiner*—David B Thomas
(74) *Attorney, Agent, or Firm*—Pillsbury Winthrop Shaw Pittman LLP

(57) ABSTRACT

A wrench is configured to engage a fastener for rotation. In one embodiment, the wrench comprises a base, a pair of jaws, a pair of threaded shafts, an adjusting ring, and/or a sleeve. The position of the pair of jaws along the base may be adjustable to accommodate fasteners of different sizes.

19 Claims, 3 Drawing Sheets

U.S. PATENT DOCUMENTS

| | | | | |
|---|---|---|---|---|
| 5,819,607 | A * | 10/1998 | Carnesi | 81/128 |
| 5,893,306 | A | 4/1999 | Owoc | |
| 6,073,522 | A | 6/2000 | Carnesi | |
| 6,145,413 | A | 11/2000 | Lin | |
| 6,662,689 | B1 * | 12/2003 | Voskanyan | 81/163 |
| 6,752,047 | B1 * | 6/2004 | Lee | 81/60 |
| 6,971,284 | B2 | 12/2005 | Owoc | |
| 7,062,996 | B2 | 6/2006 | Johnson | |
| 7,261,021 | B1 | 8/2007 | Carnesi | |
| 2004/0069098 | A1 | 4/2004 | Chang | |
| 2005/0166717 | A1 | 8/2005 | Owoc | |
| 2006/0086211 | A1 | 4/2006 | Johnson | |
| 2006/0137493 | A1 | 6/2006 | Nagata | |
| 2006/0196317 | A1 | 9/2006 | Kinskey | |

* cited by examiner

ADJUSTABLE RATCHET

FIELD OF THE INVENTION

The invention relates to a wrench that is adaptable to drive fasteners of different sizes, and, more particularly, to a wrench that includes a wrench head that is selectively engaged with a handle and is adaptable to drive fasteners of different sizes.

BACKGROUND OF THE INVENTION

Wrench heads that are selectively engaged with a handle to drive a fastener are also known. For example, a typical ratchet wrench set will usually include one or more ratcheting handles and a plurality of socket wrench heads, with each head corresponding to a different size of fastener. This type of ratchet wrench may be inconvenient to use because of the requirement that each size of fastener be driven with a corresponding socket wrench head. This requirement generally necessitates that the plurality of socket wrench heads be available, and that work be stopped to replace the socket wrench heads on the handle to drive fasteners of different sizes.

SUMMARY

One aspect of the invention relates to a wrench configured to engage a fastener for rotation. In one embodiment, the wrench comprises a base, a pair of jaws, a pair of threaded shafts, and an adjusting ring. The base comprises a face on one end and a drive body formed toward an end of the base opposite the face, with the face including a surface that is oriented toward a fastener if the fastener is engaged by the wrench, and the base having a conduit therein. Each of the jaws includes a gripping section and a foot. The foot is adapted to be slidably seated within the conduit formed in the base so that the jaws are carried by the base with the gripping sections of the jaws being opposed to each other adjacent to the face of the base. The foot has a threaded opening therein. The pair of threaded shafts are seated within the base inside the conduit such that each of the threaded shafts passes through one of the threaded openings formed in the feet of the jaws such that rotation of the threaded shafts causes the jaws to be actuated toward or away from each other. Each of the threaded shafts includes a spurred member on an end that is external to the jaw through which the threaded shaft extends. The adjusting ring is disposed around the base such that the adjusting ring can be rotated about the base, and includes a set of teeth that engage the spurred members of the threaded shafts such that rotation of the adjusting ring about the base causes rotation of the threaded shafts, thereby actuating the jaws toward or away from each other.

Another aspect of the invention relates to a wrench configured to engage a fastener for rotation. In one embodiment, the wrench comprises a base, a pair of jaws, an adjusting ring, and a sleeve. The base runs longitudinally between a face on one end and a drive body formed toward the end of the base opposite the face. The face is a surfaces that is oriented toward a fastener if the fastener is engaged by the wrench. The jaws have gripping sections that are carried adjacent to the base, are adapted to engage the fastener, and are configured to oppose each other. The adjusting ring is carried around the periphery of the base such that the adjusting ring can be rotated about the base to actuate the jaws such that the gripping sections of the jaws move toward or away from each other based on the rotational direction of the rotation of the adjusting ring about the base. The sleeve is formed separately from the adjusting ring and is carried about the base such that the sleeve can rotate about the base separately from the adjusting ring and/or the base.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
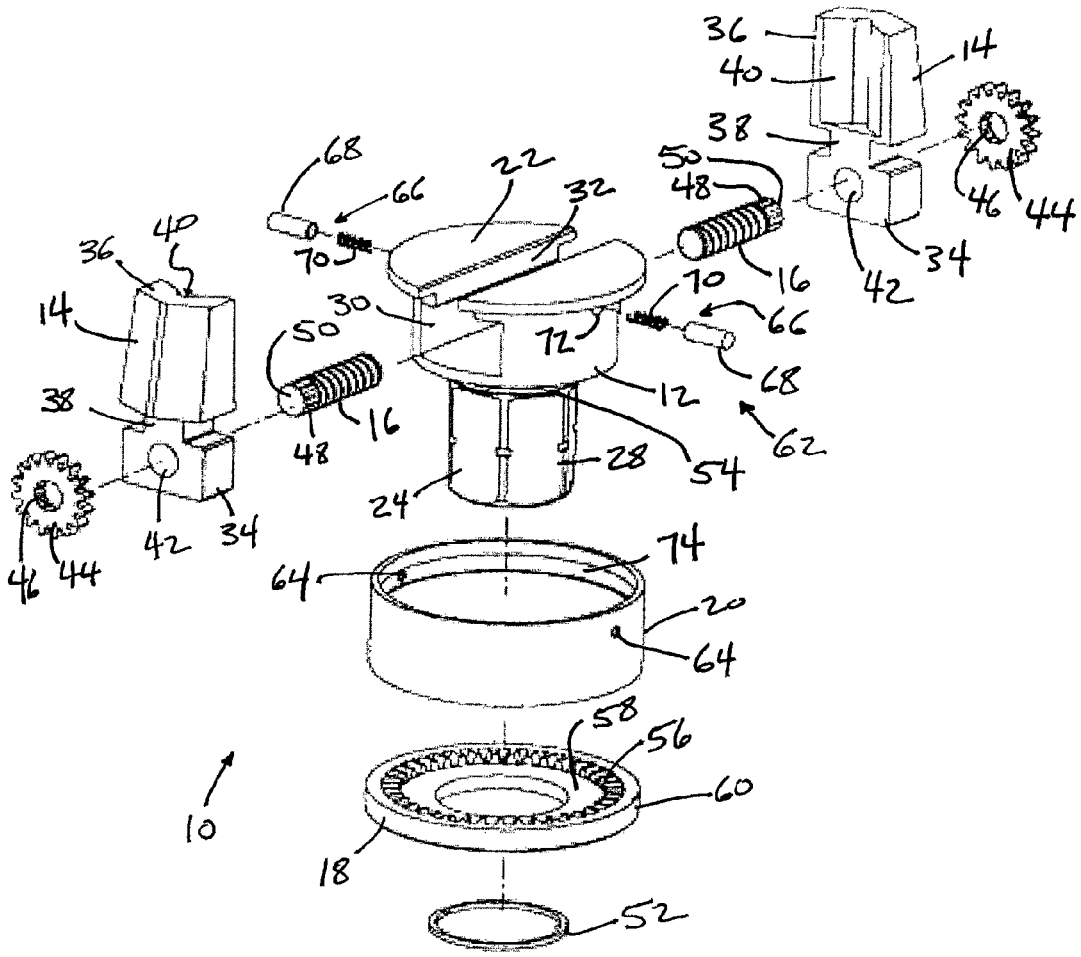
FIG. 1 illustrates an exploded view of a wrench head, in accordance with one or more embodiments of the invention.
Figure 2:
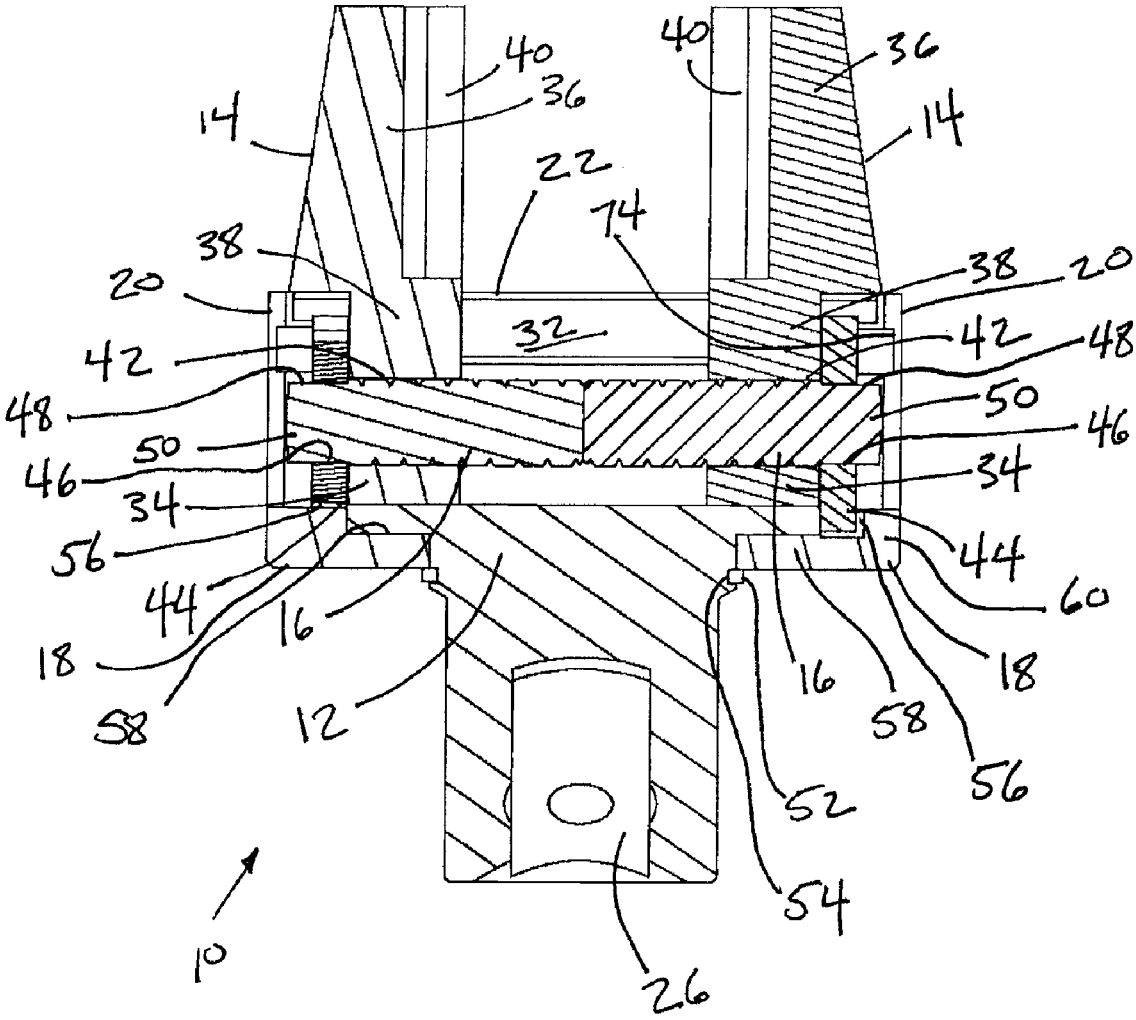
FIG. 2 illustrates a sectional view of a wrench head, according to one or more embodiments of the invention.
Figure 3:
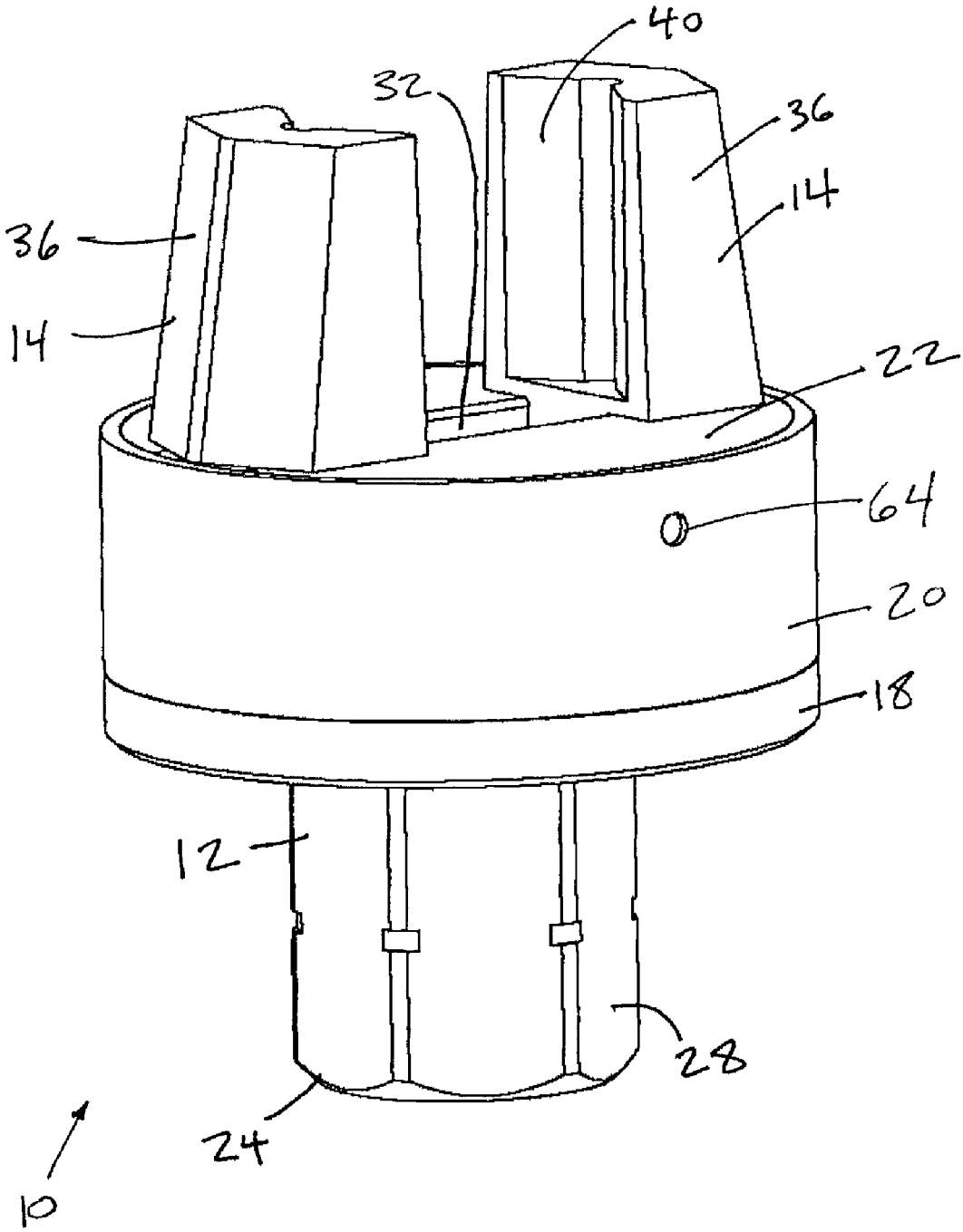
FIG. 3 illustrates a perspective view of a wrench head, in accordance with one or more embodiments of the invention.

FIG. 1 illustrates an exploded perspective view of a wrench head 10, in accordance with one or more embodiments of the invention. When assembled (e.g., as shown in FIGS. 2 and 3, discussed below), wrench head 10 may form part of a wrench configured to engage a fastener and drive the fastener rotationally. As can be seen in FIG. 1, wrench head 10 includes a base 12, a pair of jaws 14, a pair of threaded shafts 16, an adjusting ring 18, and a sleeve 20.

In one embodiment, base 12 runs longitudinally between a face 22 on one end and a drive body 24 formed toward the end of base 12 opposite face 22. Face 22 includes one or more surfaces that are oriented toward a fastener, if the fastener is engaged by wrench head 10. More particularly, in some instances, face 22 includes one or more surfaces that are substantially orthogonal to an axis of rotation about which wrench head 10 drives the fastener. Drive body 24 is formed to be engaged by a handle (not shown) to drive wrench head 10 rotationally. For example, drive body 24 may include one or both of a socket to receive a conventional square driver (e.g., as can be seen as socket 26 in the sectional view of FIG. 3) and/or a hexagonal body 28 that can be engaged by a conventional hexagonal wrench (e.g., a box wrench, a hexagonal socket, etc.).

Base 12 forms a conduit 30 that passes through base 12 from one side to the other, and a slot 32 in face 22 that communicates with conduit 30. In the illustration of wrench head 10 shown in FIG. 1, conduit 30 has a rectangular cross-section, but this is not intended to be limiting. Slot 32 is illustrated as running across face 22 from one side to the other. However, in other embodiments, slot 32 may not completely sever face 22 into separate surfaces. Instead, slot 32 may be ended at the periphery of face 22.

Jaws 14 each include a foot 34, a gripping section 36, and a neck 38. Gripping sections 36 are configured to cooperate engage a fastener positioned therebetween at gripping surfaces 40. Neck 38 connects foot 34 with gripping section 36. Each of feet 34 forms a threaded opening 42 therein.

One end of threaded shaft 16 carries a spurred member 44. In the embodiment shown in FIG. 1, spurred member 44 is an annular spur gear that is formed separately from threaded shaft 16, and includes an inward set of teeth 46 that engage a set of teeth 48 formed on a head 50 of threaded shaft 16 to fix spurred member 44 rotationally with respect to threaded shaft 16. This is not intended to be limiting. Other mechanisms for attaching spurred member 44 to threaded shaft 16 to ensure that member 44 and shaft 16 rotate in unison are contemplated, as are embodiments in which spurred member 44 is formed integrally with threaded shaft 16.

Adjusting ring 18 is adapted to be carried around the periphery of base 12 between face 22 and drive body 24. To hold adjusting ring 18 in place on base 12, wrench head 10 may include a retaining ring 52 that locks into a groove 54 formed in base 12. Adjusting ring 18 may include a an annular set of teeth 56 that face toward face 22 of base 12 when adjusting ring 18 is disposed on base 12, a rearward shelf 56 that faces toward drive body 24 of wrench head 10, and an annular shell 58 that is formed externally to teeth 56.

Sleeve 20 is formed separately from adjusting ring 18, and is configured to be disposed about base 12 between adjusting ring 18 and face 22. A catch mechanism 62 that selectively engages with sleeve 20 includes one or more holes 64 formed in sleeve 20 and one or more or more catches 66. Catches 66 include a hollow pin 68 and a spring 70 (or other biasing member). Spring 70 is formed to fit within hollow pin 68, and pin 68 is formed to be at least partially nested within a cavity 72 formed in the side of base 12.

FIG. 2 illustrates a sectional view of wrench head 10, in accordance with one or more embodiments of the invention. As can be seen in FIG. 2, in one embodiment, neck 38 of jaw 14 is adapted to fit slidably within slot 32, thereby enabling gripping section 36 of jaw 14 to sit externally to face 22 while foot 34 is disposed within conduit 30. Threaded openings 42 are formed within feet 34 such that if one of feet 34 is disposed within conduit 30 in the manner shown in FIG. 2, the threaded opening 42 formed in that foot 34 is oriented radially with respect to base 12.

Threaded shafts 16 are seated radially within base 12 inside conduit 30 such that each of threaded shafts 16 extends through one of threaded openings 42 formed in feet 34 of jaws 14. Threaded shafts 16 are situated such that spurred members 44 are seated on an external side of jaws 14. The threads of threaded shafts 16 engage the threads of threaded openings 42 such that rotation of threaded shafts 16 about their longitudinal axes will actuate jaws 14 to slide inward or outward (depending on the direction of rotation of shafts 16) radially with respect to base 12, provided that the radial position of threaded shafts 16 is fixed (or at least secured) with respect to base 12. As can be seen in FIG. 2, in one embodiment, the radial position of threaded shafts 16 is fixed by sleeve 20, which is disposed about base 12 at the openings of conduit 30, thereby securing threaded shafts 16 within conduit 30. Further, in the embodiment shown in FIG. 2, the radial position of threaded shafts 16 is secured by an abutment between shafts 16. It should be appreciated that in some embodiments, shafts 16 may not abut directly, but instead some component may be inserted between them to secure their radial positioning.

Adjusting ring 18 may be seated on base 12 such that teeth 56 are configured to engage the spurs of spurred members 44. As such, rotation of adjusting ring 18 about base 12 separate from rotation of base 12 causes rotation of spurred members 44 and threaded shafts 16, which in turn drives jaws 14 to move toward or away from each other (depending on the direction of rotation of adjusting ring 18 with respect to base 12).

When sleeve 20 is in place on base 12, sleeve 20 can be rotated about base 12 separately from adjusting ring 18 and/or base 12. This enables a user to grasp sleeve 20 to while driving wrench head 10 rotationally, thereby providing a mechanism by which the user can guide and support wrench head 10 as it is being used to drive a fastener. This is illustrated, for example, in FIG. 3, which shows a perspective view of wrench head 10 fully assembled, according to one or more embodiments of the invention. As should be appreciated from FIG. 3, the outer surface of sleeve 20 provides a surface that can be held in a fixed rotational position by the user as the rest of wrench head 10 is being rotated to drive a fastener. This will enable the user to stabilize wrench head 10 during rotation.

In order to facilitate rotation of adjusting ring 18 separate from base 12 to adjust the positions of jaws 14, catch mechanism 62 can selectively catch sleeve 20 to prevent relative rotation between sleeve 20 and base 12 when wrench head 10 is not being used to drive a fastener. This will enable a user to rotate adjusting ring 18 relative to base 12 (e.g., to adjust the relative positions of jaws 13) by grasping the outer surface of sleeve 20 and adjusting ring 18, and rotating sleeve 20 and adjusting ring 18 in opposite directions (or rotating one with respect to the other). If, by virtue of the engaged catch mechanism 62, sleeve 20 is selectively locked with respect to base 12, this manipulation by the user results in the rotation of base 12 and adjusting ring with respect to each other.

Turning back to FIG. 1, as was mentioned above, catch mechanism 62 includes one or more holes 64 formed in sleeve 20 and one or more or more catches 66. If catches 66 are not aligned with holes 64, then catches 66 are compressed and forced into cavities 72 by the side of sleeve 20. If catches 66 become aligned with holes 64, then the bias applied to pins 68 by springs 70 force pins 68 into holes 64, thereby fixing sleeve 20 rotationally with respect to base 12. In order to release catches 66 from holes 64, the user may manually compress catches 66 out of holes 64 and rotate sleeve 20 with respect to base 12, thereby moving holes 64 and catches 66 out of alignment. A groove 74 formed in the inner surface of sleeve 20 may act as a track for catches 66 as sleeve 20 rotates about base 12.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A wrench configured to engage a fastener for rotation, the wrench comprising:

a base comprising a face on one end and a drive body formed toward an end of the base opposite the face, the face including a surface that is oriented toward a fastener if the fastener is engaged by the wrench, the base having a conduit therein;

a pair of jaws, wherein each of the jaws includes a gripping section and a foot, the foot being adapted to be slidably seated within the conduit formed in the base so that the jaws are carried by the base with the gripping sections of the jaws being opposed to each other adjacent to the face of the base, the foot having a threaded opening therein;

a pair of threaded shafts seated within the base inside the conduit such that each of the threaded shafts passes through one of the threaded openings formed in the feet of the jaws such that rotation of the threaded shafts causes the jaws to be actuated toward or away from each other, wherein each of the threaded shafts includes a spurred member on an end that is external to the jaw through which the threaded shaft extends; and an adjusting ring disposed around the base such that the adjusting ring can be rotated about the base, the adjusting ring including a set of teeth that engage the spurred members of the threaded shafts such that rotation of the adjusting ring about the base causes rotation of the threaded shafts, thereby actuating the jaws toward or away from each other.

2. The wrench of claim 1, wherein the base forms a slot in the face that communicates with the conduit formed by the base, and wherein the jaws comprise necks that extend from the feet seated in the conduit to the jaws external from the face through the slot formed in the face.

3. The wrench of claim 1, wherein the adjusting ring is held in place on the base by a retaining ring that engages the base.

4. The wrench of claim 1, further comprising a sleeve that is formed separately from the adjusting ring and is carried about the base such that the sleeve can rotate about the base separately from the adjusting ring and/or the base, the sleeve covering the openings of the conduit formed through the base.

5. The wrench of claim 4, further comprising a catch mechanism that selectively catches the sleeve to prevent the sleeve from rotating separately from the base.

6. The wrench of claim 1, wherein the pair of jaws are all of the jaws of the wrench configured to engage the fastener.

7. The wrench of claim 1, further comprising a handle that engages the drive body to drive the base rotationally.

8. The wrench of claim 7, wherein the handle removably engages the drive body.

9. The wrench of claim 1, wherein the conduit runs through the base from one side to the other.

10. The wrench of claim 1, wherein the gripping section and the foot of each jaw are connected by a neck that has a narrower profile than either of the foot or the gripping section.

11. A wrench configured to engage a fastener for rotation, the wrench comprising:

a base that runs longitudinally between a face on one end and a drive body formed toward the end of the base opposite the face, the face being a surface that is oriented toward a fastener if the fastener is engaged by the wrench;

a pair of jaws carried by the base, the jaws having gripping sections that are carried adjacent to the base and are adapted to engage the fastener, the gripping sections being configured to oppose each other;

an adjusting ring that is carried around the periphery of the base such that the adjusting ring can be rotated about the base to actuate the jaws such that the gripping sections of the jaws move toward or away from each other based on the rotational direction of the rotation of the adjusting ring about the base; and a sleeve that is formed separately from the adjusting ring and is carried about the base such that the sleeve can rotate about the base separately from the adjusting ring and/or the base.

12. The wrench of claim 11, further comprising a catch mechanism that selectively catches the sleeve to prevent the sleeve from rotating separately from the base.

13. The wrench of claim 12, wherein the catch mechanism is spring loaded.

14. The wrench of claim 13, wherein the catch mechanism comprises one or more holes formed in the sleeve, and one or more catches that are carried by the base between the base and the sleeve, the catches being compressed between the base and the sleeve such that if the one or more holes formed in the sleeve come into alignment with the one or more catches, the one or more catches slide into the one or more holes, thereby securing the sleeve to the base such that the base cannot be rotated separately from the base.

15. The wrench of claim 14, wherein a given one of the one or more catches comprises a pin and a spring.

16. The wrench of claim 11, wherein the pair of jaws are all of the jaws of the wrench configured to engage the fastener.

17. The wrench of claim 11, further comprising a handle that engages the drive body to drive the base rotationally.

18. The wrench of claim 17, wherein the handle removably engages the drive body.

19. The wrench of claim 11, wherein the adjusting ring is held in place on the base by a retaining ring that engages the base.

* * * * *